US008402907B2

(12) United States Patent
Cleveland et al.

(10) Patent No.: US 8,402,907 B2
(45) Date of Patent: Mar. 26, 2013

(54) BOAT CLEAT ASSEMBLY

(75) Inventors: Rafael Cleveland, Aledo, TX (US); Jason Samowski, Jacksonville, FL (US)

(73) Assignee: GEM Products, Inc., Orange Park, FL (US)

( * ) Notice: Subject to any disclaimer, the term of this patent is extended or adjusted under 35 U.S.C. 154(b) by 0 days.

(21) Appl. No.: 13/216,816

(22) Filed: Aug. 24, 2011

(65) Prior Publication Data

US 2012/0017819 A1 Jan. 26, 2012

Related U.S. Application Data

(63) Continuation-in-part of application No. 12/794,849, filed on Jun. 7, 2010.

(51) Int. Cl.
*B63B 21/04* (2006.01)

(52) U.S. Cl. ..... 114/218

(58) Field of Classification Search ..... 114/218; 410/107, 111

See application file for complete search history.

(56) References Cited

U.S. PATENT DOCUMENTS

| | | | | |
|---|---|---|---|---|
| 3,365,162 | A * | 1/1968 | Davis | 410/111 |
| 6,588,355 | B1 * | 7/2003 | Whitley et al. | 114/218 |
| 6,672,237 | B2 * | 1/2004 | Hillier | 114/230.2 |
| 2004/0099197 | A1 * | 5/2004 | King | 114/218 |
| 2008/0121161 | A1 * | 5/2008 | Pugh | 114/218 |
| 2011/0099883 | A1 * | 5/2011 | Baltes | 43/21.2 |

OTHER PUBLICATIONS

Rex Marine Accon pop-up bezel publication, Nov. 4, 2006.*

* cited by examiner

*Primary Examiner* — Edwin Swinehart
(74) *Attorney, Agent, or Firm* — Seyfarth Shaw LLP

(57) ABSTRACT

A movable cleat assembly is provided. The movable cleat includes a support base, a face plate positioned adjacent the support base and a retractable cleat. The retractable cleat includes a handle portion and at least one leg extending through the support base and the face plate. The face plate further includes an edge that is adapted to deform or otherwise embed a portion of itself into a boat when installed. At least one of the support base and face plate includes at least one tube to receive the leg therein. The at least one tube is composed of a corrosion-proof material.

12 Claims, 5 Drawing Sheets

BOAT CLEAT ASSEMBLY

CROSS-REFERENCE TO RELATED APPLICATIONS

This application is a continuation-in-part of U.S. application Ser. No. 12/794,849, filed Jun. 7, 2010, the contents of which are incorporated by reference herein in their entirety.

TECHNICAL FIELD OF THE INVENTION

The present device relates to boat cleats. Particularly, the present device relates to boat cleats that are movable between an extended operating condition and a retracted stowed condition.

BACKGROUND OF THE INVENTION

Cleats are used for recreational boating for securing mooring lines and the like. Further, retractable cleats are also used wherein the cleat may be retracted to provide a sleeker appearance and also be positioned out of the way when not in use so to avoid, for example, boaters tripping over the cleat or otherwise injuring themselves.

Generally, such retractable cleats include a face plate and a retractable cleat all formed of metal. In such a form, the retractable cleat includes a handle portion and usually two legs which extend into two tubes on the face plate for guiding the legs. However, in such a configuration, the components of the assembly are prone to contact with water, and many times salt water, and, therefore, are prone to corrosion, which may cause premature failure, the legs seizing within the tubes, excessive water leakage through the tubes, and/or rattling due to relative size changes of the components. Moreover, because of its metal construction, the legs and or tubes are susceptible to not only corrosion, but also wear such that the combination of corrosion and wear may cause the components to become loose and/or otherwise inoperable.

SUMMARY OF THE INVENTION

According to one form, a movable cleat assembly is provided. The movable cleat includes a support base, a face plate positioned adjacent the support base and a retractable cleat. The retractable cleat includes a handle portion and at least one leg extending through the support base and the face plate. At least one of the support base and face plate includes at least one tube to receive the leg therein. The at least one tube is composed of a corrosion-proof material.

In accordance with one form, a movable cleat assembly is provided. The movable cleat assembly includes a support base, a face plate and a retractable cleat. The support base includes at least one tube. The face plate is positioned adjacent the support base. The face plate is a separate component from the support base. The retractable cleat has a handle portion and at least one leg extending through the support base and the face plate and into the at least one tube.

According to one form, a cleat assembly is provided. The cleat assembly includes a support base, a face plate and a cleat. The support base includes an upper surface and a lower surface. The lower surface extends along a lower plane. The face plate is positioned adjacent the upper surface of the support base. The face plate is a separate component from the support base and includes an edge portion extending along an edge plane which is located below the lower plane. The cleat has a handle portion and at least one leg extending from the handle portion.

In accordance with one form, the corrosion-proof material is a plastic.

In one form, the corrosion-proof material is nylon.

According to one form, the retractable cleat further includes a bushing positioned about the at least one leg and contacts an interior portion of the at least one tube.

In accordance with one form, the assembly further includes a drain coupled to the at least one leg to direct the flow of any water away from the assembly after entering the at least one leg.

According to one form, the at least one tube is integral with the support base.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
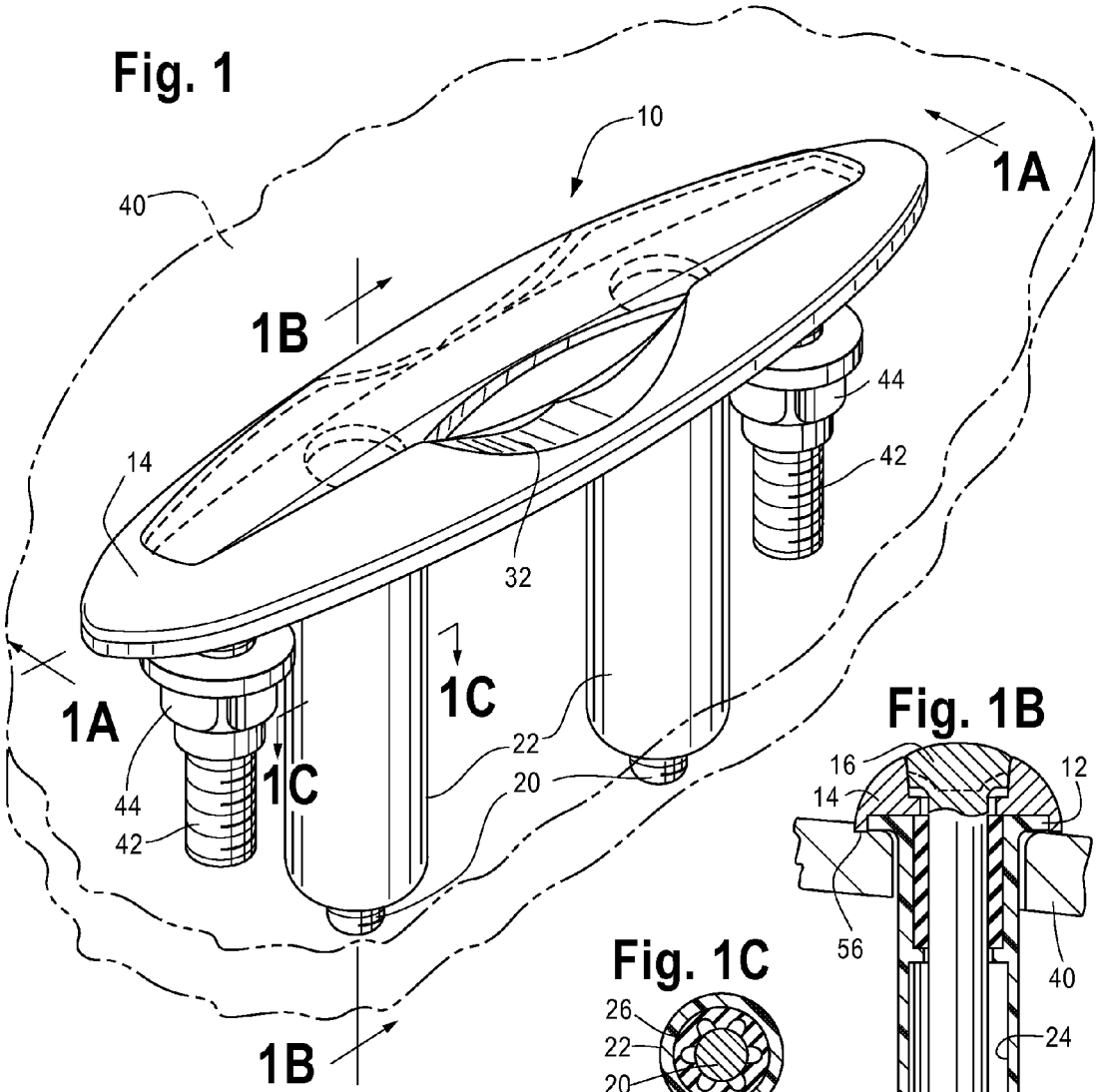
FIG. 1 is a perspective view one form of a boat cleat assembly installed on a boat deck, the boat deck being shown in phantom.
Figure 1B:
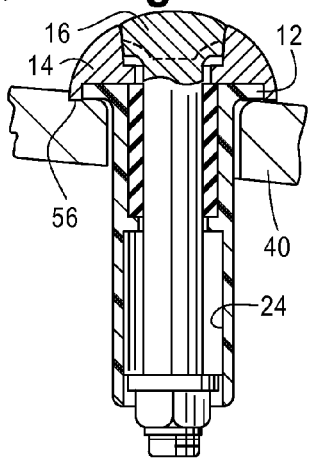
FIG. 1B is a cross-sectional view taken along line 1B-1B of FIG. 1.

It should be understood that the comments included in the notes as well as the materials, dimensions and tolerances discussed therein are simply proposals such that one skilled in the art would be able to modify the proposals within the scope of the present application.

DETAILED DESCRIPTION OF PREFERRED EMBODIMENTS

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

Referring to FIG. 1, there is illustrated one form of a cleat assembly 10 illustrating the various components. In one form, as shown on FIG. 1, the assembly includes a support base 12, a face plate 14 positioned adjacent the support base 12 and a retractable cleat 16. In one form, the retractable cleat 16 includes a handle portion 18 and at least one depending leg 20. As shown in FIG. 1, this embodiment includes two depending legs 20. Further, the legs 20 extend through the support base 12 and the face plate 14.

Figure 1C:
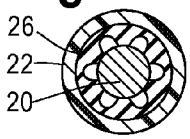
FIG. 1C is a cross-sectional view taken along line 1C-1C of FIG. 1.

At least one of the support base 12 and the face plate 14 include at least one depending tube 22 to receive the leg 20 therein. As shown in FIG. 1, the assembly 10 includes two legs 20 and the legs 20 are integral or otherwise form a part of the support base 12. It should be understood that the legs 20 and tubes 22 may take any form and may have any cross-sectional shape as desired. For example, as best seen in FIG. 1C, the legs 20 and tubes 22 have a circular cross-sectional shape. However, the legs 20 and tubes 22 may have other cross-sectional shapes, including, but not limited to, square, rectangular, triangular and the like.

In one form, the tube 22 is made from a corrosion-proof material. In this regard, one skilled in the art should understand that a wide variety of materials may be considered corrosion-proof. For example, such materials include, but are not limited to, plastics, resins, rubber, combinations thereof and the like. Additionally, an interior surface 24 of the tube 22 may include a smooth or rough finish as desired.

The assembly may also include one or more bushings 26 coupled to the legs 20. The bushings 26 may be positioned to surround at least a portion of the legs 20 and may be adapted to frictionally abut the inner wall 24 of the tubes 22. In this regard, the bushings 26 may be used to decrease wear on the assembly 10 as the retractable cleat 16 is moved between an extended position and retracted position. Further, the bushings 26 may help provide a substantially water-tight seal between the leg 20 and inner wall 24 of the tubes 22. The bushings 26 may be made from a variety of materials as understood by those skilled in the art. For example, in one form, the bushings 26 may be made from plastic, resin, nylon and the like. The assembly 10 may also include one or more washers 28 and nuts 30 to secure the legs 20 within the tubes 22.

Figure 1A:
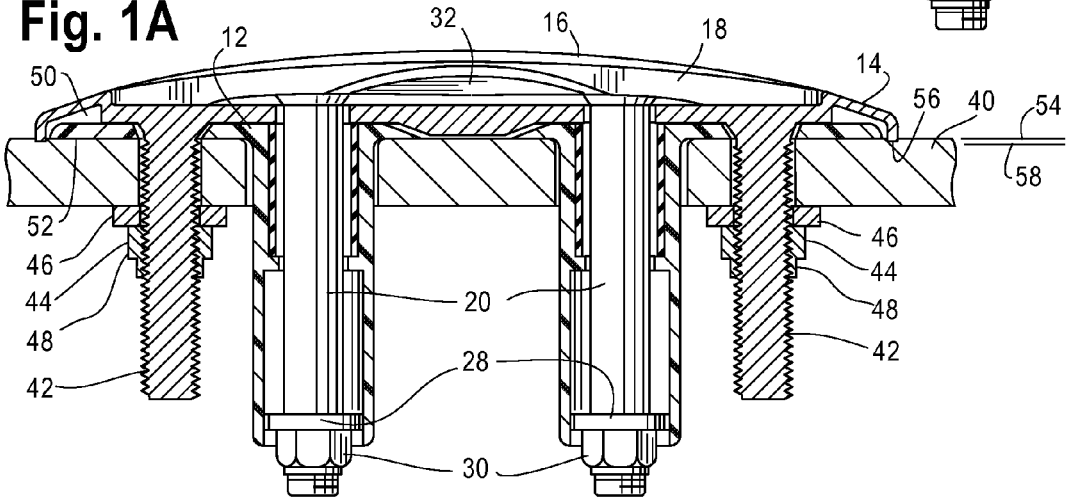
FIG. 1A is a cross-sectional view taken along line 1A-1A of FIG. 1.

The assembly 10 may also include one or more recesses 32 on the face plate 14 and/or the retractable cleat 16, as shown in FIGS. 1 and 1A. In this regard, the recesses 32 may be adapted to assist a user in grasping the handle 18 of the retractable cleat 16 with the user's fingers.

The assembly 10 may also include a drain assembly operably coupled to the tubes 22. The drain assembly may be used to drain any water that may collect in the tubes 22 away from the tubes 22 and minimize any leakage or corrosion to the legs 20 of the cleat and the like. While the drain assembly is not shown, such assemblies are known and understood by those skilled in the art.

The components of the assembly 10 may be made from a variety of similar and dissimilar materials. For example, as discussed above, the tubes 22 are preferably made from a corrosion-proof material. The remaining components of the assembly may be made from similar material. Alternatively, other components may be made from different materials. For example, the face plate 14 and retractable cleat 16 may be manufactured from steel, stainless steel, marine grade stainless steel, aluminum and the like. Construction of the tubes 22 of a corrosion-resistant material will minimize corrosion of the tubes 22 and corrosion-induced seizing of the tubes 22 to the legs 20, wherein such corrosion typically makes utilization of the cleat difficult, if not impossible. Use of a corrosion-resistant material also minimizes metal-to-metal clattering that may otherwise occur due to relational size differences between the components that occurs due to corrosion.

The assembly 10 may be constructed and installed as illustrated in the drawings and as understood by those skilled in the art. For example, the assembly 10 may include adhesive between the face plate 16 and support base 14 such that the two components leave the factory as a subassembly. During installation, the support base 14 is placed against a boat 40 or other structure and studs 42 extending from the face plate 16 are positioned through openings in the boat 40 whereby fasteners 44 are used to secure the assembly 10 to the boat 40, such as shown in FIG. 1. In one form, the studs 42 are threaded and washers 46 and nuts 48 are used to secure the assembly 10.

In one form, the support base 12 includes an upper surface 50 and a lower surface 52. The lower surface 52 extends along a lower plane, represented by dashed line 54, when installed on the boat 40 or other surface. When installed, the face plate 14 is positioned adjacent or above the upper surface 50 of the support base 12. The face plate 14 may include an edge portion 56. When installed, the edge portion 56 extends along an edge plane, represented by dashed line 58. The edge plane 58 is located below the lower plane 54. In this regard, the edge portion 56 is configured to deform and/or embed a portion of itself into a portion of the boat 40 when installed. As the edge portion 56 deforms or otherwise bites into the surface of the boat 40, it will help seal the assembly 10 to the boat 40. Furthermore, standard cleats are generally cast products that are flat. A flat cleat on an uneven surface, such as a boat deck surface, may wobble and significant amounts of sealant may be required to help seal the cleat. The edge portion 56 will help prevent wobble and improve the seal, including the aesthetic appearance thereof.

Moreover, conventional, cast flat cleats may warp when tightened down. This warping may cause the legs of the movable cleat to bind as it is extended and retracted. In one form, as the support base 12 and the face plate 14 are two separate components, this warping may be minimized. Further, the edge portion 56 may also help minimize warping. Additionally, in one form, the support base 12 is made of a plastic material, such as nylon, such that the material selection may also help minimize warping.

Figure 2:
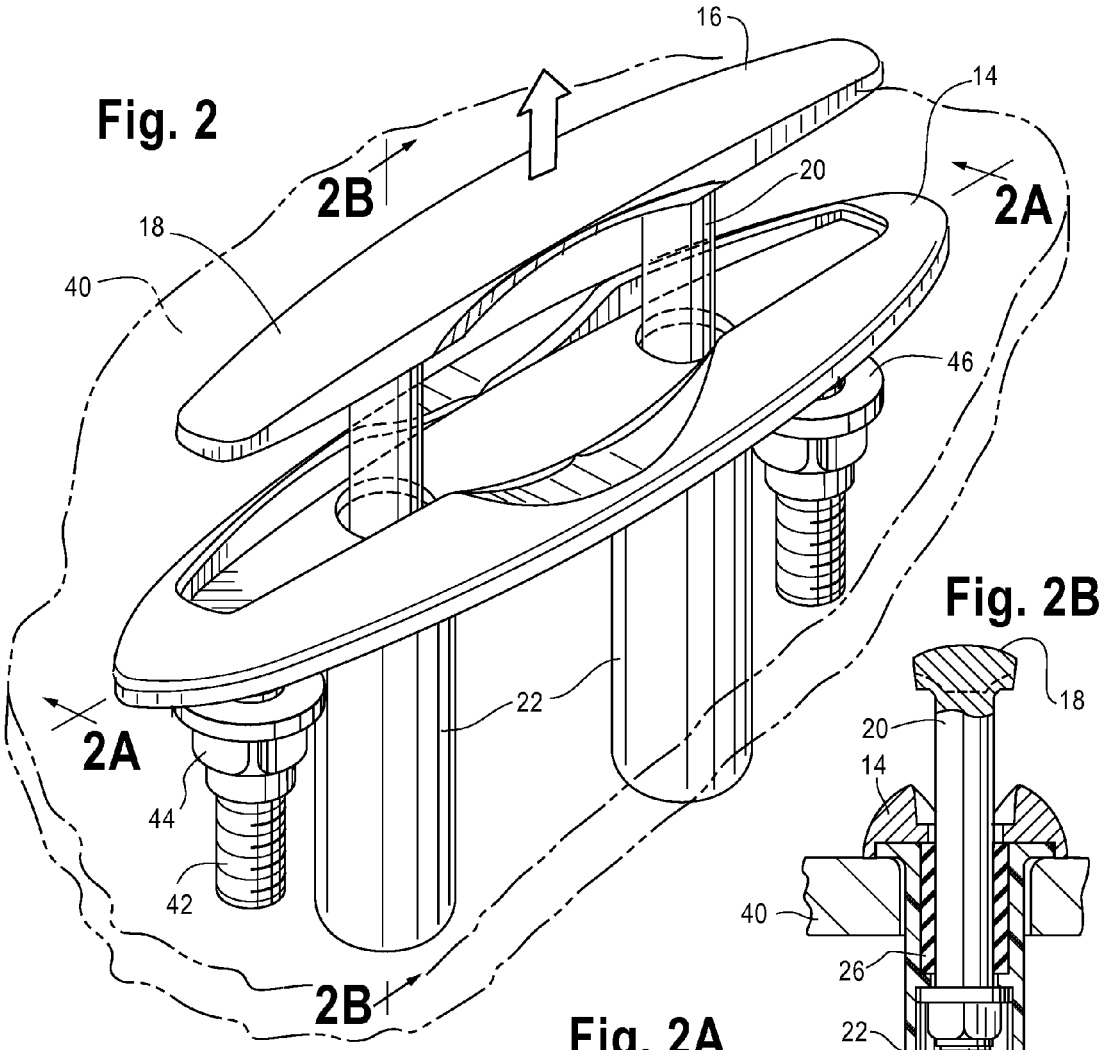
FIG. 2 is a perspective view of one form of a boat cleat assembly installed on a boat deck showing a retractable cleat being positioned towards an extended position, the boat deck being shown in phantom.
Figure 2B:
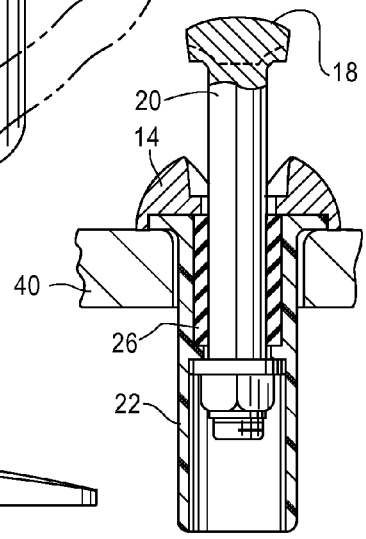
FIG. 2B is a cross-sectional view taken along line 2B-2B of FIG. 2.
Figure 2A:
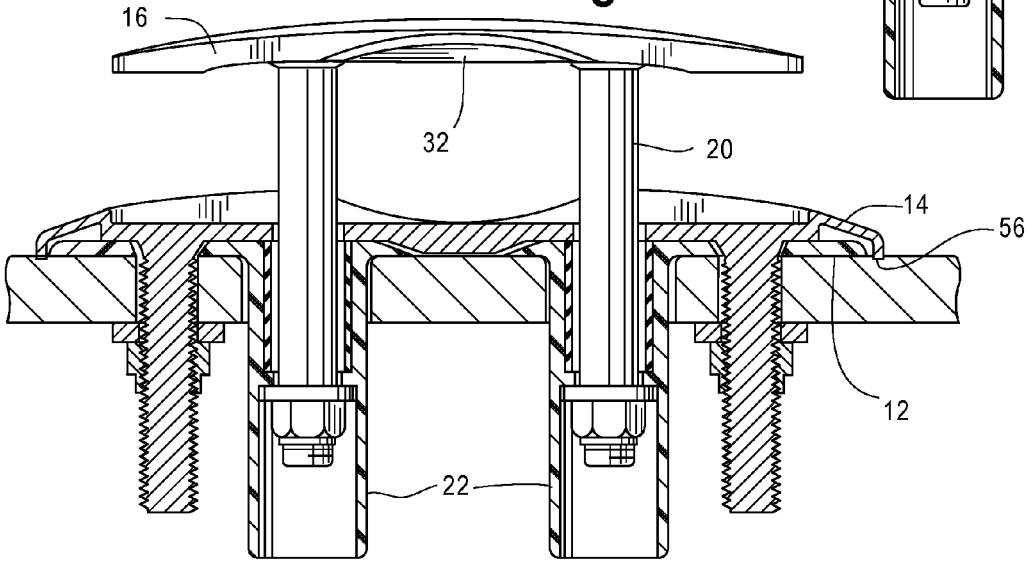
FIG. 2A is a cross-sectional view taken along line 2A-2A of FIG. 2.
Figure 3:
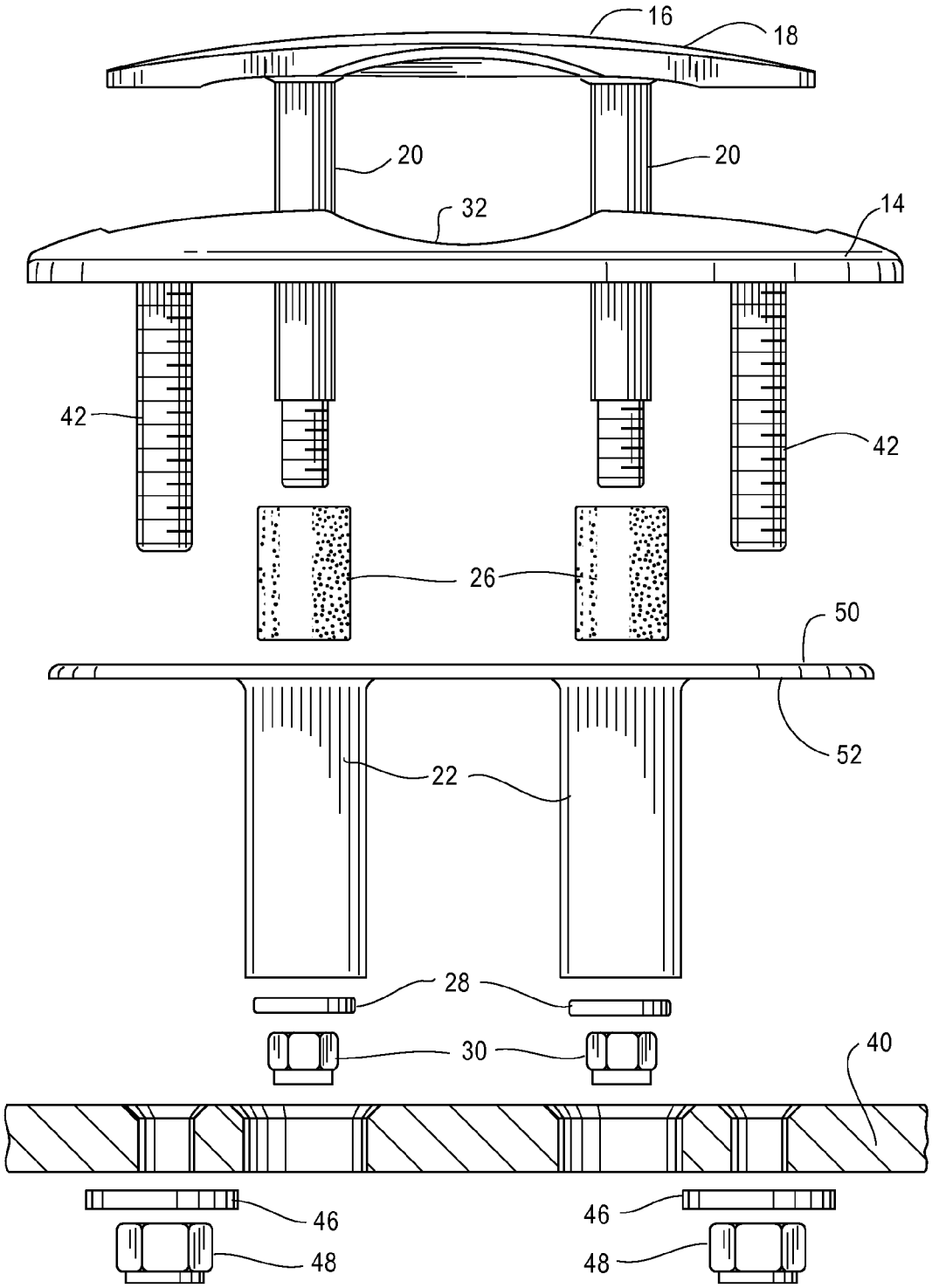
FIG. 3 is an exploded view of one form of a boat cleat assembly.
Figure 4A:
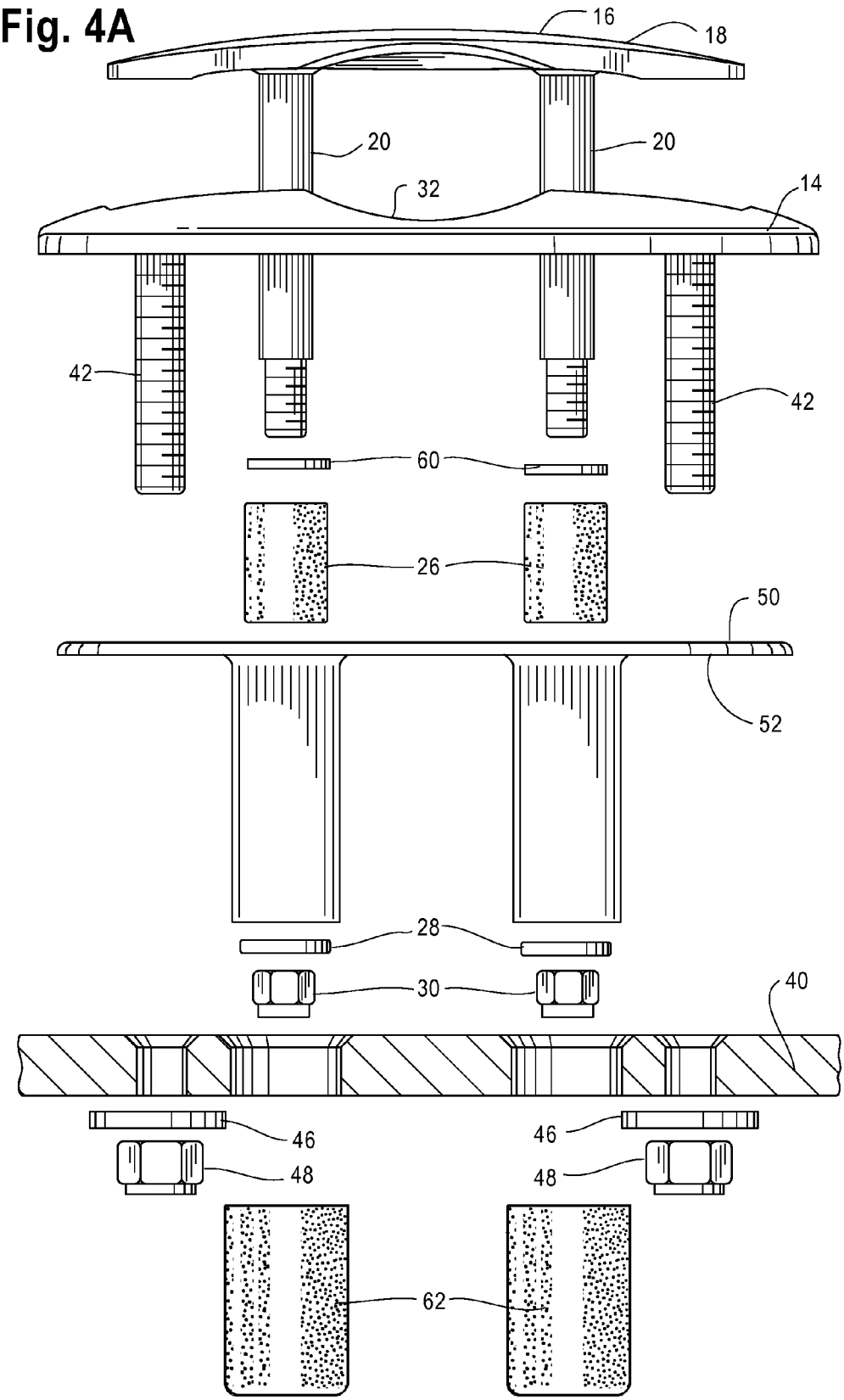
FIG. 4A is an exploded view of another form of a boat cleat assembly.
Figure 4B:
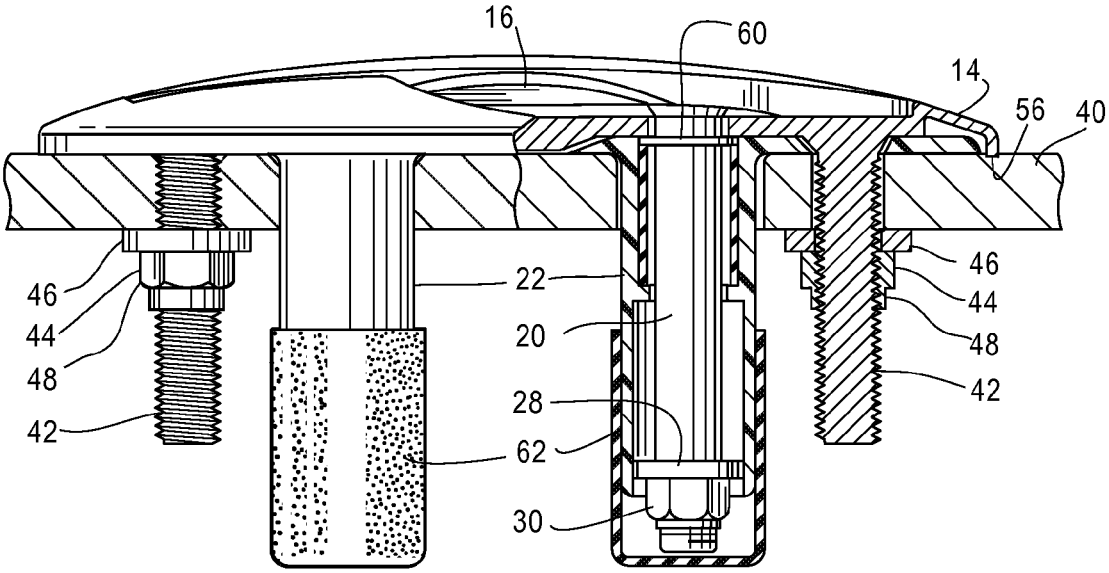
FIG. 4B is a side view of the assembly, as assembled.

FIG. 4 illustrates an exploded view of a boat cleat similar to FIGS. 1-3, and where like numerals represent like elements. The embodiment of FIG. 4 includes a washer 60 provided on each leg 20 and a cap 62 provided on the end of each tube 22. The washer 60 and cap 62 create virtually a water-tight seal on the leg 20 and tube, respectively, to make the assembly 10 even more water resistant.

The washer 60 can be made of rubber or any other suitable material that is capable of gripping the leg 20 and providing a seal along the leg 20. The washer 60 is disposed between the top surface of the bushing 26 and the bottom surface of the face plate 14 to provide a virtually waterproof seal between the bushing 26 and face plate 14, and to protect the legs 20 from outside moisture. As shown, the washer 60 has an internal diameter that allows the washer 60 to interference fit around the leg 20, but the diameter of the washer 60 can be modified without departing from the spirit and scope of the present invention. A slight interference between the washer 60 and the leg 20 provides a more water-tight seal and creates additional friction between the washer 60 and the leg 20 so that the cleat 16 stays in its intended position.

The cap 62 can be coupled to the tube 22 or to the washer 28 to seal the tube 22 or washer 28 from outside moisture. For example, the cap 62 can be friction fit onto the tube 22 or washer 28, or can be threadably coupled to the tube 22.

Optionally, an upper end of the cap 62 partially overlaps with a lower end of the tube 22 to protect the washers 28 and nuts 30 from outside elements.

Figure 5:
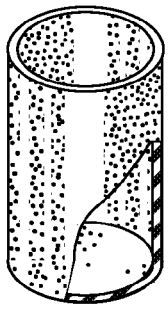
FIG. 5 is an isometric view of a cap.

The addition of the washer 60 and cap 62 protects the inside cabin of the boat from external moisture that may enter the boat through the cleat interface without such a seal. The pull-up cleat design does not drain water into the boat, nor does the cleat have to be plumbed into the boat's drainage system. As a result, the design of FIGS. 4 and 5 avoids expensive labor costs associated with integrating a cleat having insufficient sealing properties.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A moveable cleat assembly comprising:

a support base;

a face plate disposed adjacent to the support base;

a retractable cleat having a handle portion and a leg extending through the support base and an opening in the face plate, at least one of the support base and face plate including a tube to receive the leg therein, the tube constructed of a substantially corrosion-resistant material;

a bushing disposed in the tube and adapted to slidably receive and frictionally engage the leg to provide a substantially water tight seal between the leg and the bushing; and a washer circumferentially disposed on the leg and adapted to create a substantially water-tight seal between the leg and the washer, wherein the bushing and the washer frictionally engage the leg to cause the cleat to selectively remain in an extended position.

2. The movable cleat assembly of claim 1 wherein the corrosion-resistant material is a plastic.

3. The movable cleat assembly of claim 1 wherein the corrosion-resistant material is nylon.

4. The movable cleat assembly of claim 1 wherein the tube is integral with the support base.

5. The cleat assembly of claim 1, further comprising a cap coupled on an end of the tube and forming a substantially water-tight seal on the end of the tube.

6. The movable cleat assembly of claim 1, further comprising a second leg extending from the handle portion and a second tube depending from the support base, wherein the second leg is adapted to extend through the second tube.

7. A cleat assembly comprising:

a support base having an upper surface and a lower surface, the lower surface extending along a lower plane, the support base including a depending tube;

a face plate disposed adjacent to the upper surface of the support base;

a cleat having a handle portion and a leg extending from the handle portion;

a washer being friction fit on the leg;

a cap disposed on an end of the tube and forming a substantially water-tight seal on the end of the tube;

a bushing disposed in the tube and adapted to slidably receive and frictionally engage the leg to provide a substantially water tight seal between the leg and the bushing; and a washer circumferentially disposed on the leg and adapted to create a substantially water-tight seal between the leg and the washer, wherein the bushing and the washer frictionally engage the leg to cause the cleat to selectively remain in an extended position.

8. The cleat assembly of claim 7 wherein the support base is made from a substantially corrosion-resistant material and the face plate is made from a metallic material.

9. The cleat assembly of claim 8 wherein the corrosion-resistant material is a plastic.

10. The cleat assembly claim 8 wherein the corrosion-resistant material is a nylon.

11. The cleat assembly of claim 7 further comprising fasteners extending from the face plate which each extend through a boat deck when installed thereon and being adapted to couple the face plate to the boat deck.

12. The cleat assembly of claim 7, further comprising a second leg extending from the handle portion and a second tube extending from the support base, wherein the second leg is adapted to extend through the second tube.

* * * * *